US007259309B1

(12) United States Patent
Lovelace et al.

(10) Patent No.: US 7,259,309 B1
(45) Date of Patent: Aug. 21, 2007

(54) TREMOLO ACTUATOR

(76) Inventors: Robert Lovelace, 3744 SW. 99th Ave., Lake Butler, FL (US) 32054; David Miller, 5112 SW. 94th St., Gainesville, FL (US) 32608

( * ) Notice: Subject to any disclaimer, the term of this patent is extended or adjusted under 35 U.S.C. 154(b) by 9 days.

(21) Appl. No.: 11/318,924

(22) Filed: Dec. 28, 2005

Related U.S. Application Data

(60) Provisional application No. 60/663,867, filed on Mar. 21, 2005.

(51) Int. Cl.
*G10D 3/00* (2006.01)

(52) U.S. Cl. ..... 84/313; 84/313

(58) Field of Classification Search ..... 84/313
See application file for complete search history.

(56) References Cited

U.S. PATENT DOCUMENTS

| | | | | |
|---|---|---|---|---|
| 2,741,146 | A | 4/1956 | Fender | |
| 3,512,443 | A * | 5/1970 | Parson et al. | 84/313 |
| 3,686,993 | A * | 8/1972 | Fender | 84/312 R |
| 4,343,220 | A * | 8/1982 | Lundquist | 84/313 |
| 4,354,417 | A * | 10/1982 | Glaser, II | 84/312 R |
| 4,535,670 | A * | 8/1985 | Borisoff | 84/312 R |
| 4,658,693 | A * | 4/1987 | Hennessey | 84/313 |
| 4,852,448 | A * | 8/1989 | Hennessey | 84/313 |
| 5,400,684 | A * | 3/1995 | Duffy | 84/313 |
| 5,567,897 | A | 10/1996 | McEwen | |
| 5,747,713 | A * | 5/1998 | Clement | 84/313 |
| 5,814,746 | A | 9/1998 | Stafford | |
| 5,907,114 | A * | 5/1999 | Culver | 84/313 |

* cited by examiner

*Primary Examiner*—Lincoln Donovan
*Assistant Examiner*—Robert W. Horn
(74) *Attorney, Agent, or Firm*—Sven W. Hanson

(57) ABSTRACT

A simple "hands-free" electric guitar tremolo and tremolo actuator is provided. An actuator is pivotably attached to the guitar body within a rear cavity of the solid body of the instrument. A portion of the actuator bears against an external surface of the instrument's movable "floating" guitar bridge to produce the desired effect. The actuator is controlled by the user during play by moving an elongated lever that is connected to the actuator and protrudes from the guitar body cavity. The lever is preferably curved and oriented to fit against a user's hip or waist when the guitar is held adjacent to the user in the typical mode of operation of an electric guitar. In play, tremolo effect is produced by drawing the guitar toward the user's body such that the lever is forced toward the guitar body. In this manner, the user is allowed unhindered use of both hands for normal play of the guitar.

20 Claims, 7 Drawing Sheets

TREMOLO ACTUATOR

RELATED APPLICATIONS

This application claims priority from the U.S. Provisional Application having Ser. No. 60/663,867 and filed on Mar. 21, 2005.

BACKGROUND OF THE INVENTION

The present invention pertains to manual tremolos for stringed musical instruments, particularly solid-bodied electric guitars. Tremolos for string musical instruments are generally well known and are typically used to significantly change the tension on the strings of the instrument to produce tone variations.

Tremolos are currently widely used on electric guitars. A typical electric guitar tremolo includes a lever that is connected to, and extends from, a pivotable bridge block of the instrument. The lever is positioned to be operated by a player's hand adjacent the strings and near the tail of the instrument. To produce the desired effect, the performer must first play a note or chord and then move his hand to operate the tremolo lever; he typically cannot do both at the same time. An example of such a typical tremolo is shown in U.S. Pat. No. 2,741,146 to Fender.

Other devices and methods have been proposed to provide a tremolo function that avoids use of the playing hand for tremolo operation. Various pedal actuated and motor driven devices have been suggested. However, none of these are practical for the majority of guitar uses. They are far too complex or ineffective for modern guitar playing.

Other, simpler, devices have been proposed to enable a tremolo function without encumbering the player's hands. For example, a note bender attachment shown in U.S. Pat. No. 4,535,670 to Borisoff is actuated by a user's body movement through contact with an arm that extends rearwardly from the tail end of the instrument. The actuating arm is located to lie alongside of the player's hip when the instrument is held in playing position. However, the Borisoff device actuating arm is located in an ineffective location relative to the user's body such that operating motions interfere with instrument play. As well, the Borisoff device requires significant permanent alteration of the musical instrument, reducing its value, and cannot be fitted to most conventional guitars.

In U.S. Pat. No. 5,814,746 to Stafford, a pitch changer device includes a bell crank lever extending from a rear cavity in a guitar. The lever is connected to a linkage system that alters the guitar string tension. The lever is configured to be pulled by a strap to actuate the tremolo function. However, like the Borisoff device, the user's movements for actuation—pulling on a strap—does not blend smoothly with instrument play. It is not natural nor effective. As well, the device is integrated with the instrument and is not removable nor operable with conventional design instruments.

In U.S. Pat. No. 4,658,693 to Hennessey a guitar utilizes a tremolo operating arm that is rotatably attached to a pivotable bridge block, and is disposed at the rear of the instrument. Operation for tremolo effect is by bearing the operating arm against the user's body and rotating the guitar about the axis of the bridge block fulcrum. The operating arm consists of two relatively large paddle-like elements that are permanently fixed to the bridge block. Such a permanent fixation both reduces the value of the guitar and adds the risk of potential damage due to incidental contact to the operating arm. As well, the guitar must be stored with the operating arm attached, eliminating the use of standard guitar cases. Also, the permanent connection makes the instrument essentially unusable by those not wishing to employ the tremolo.

In U.S. Pat. No. 4,852,448 to Hennessey a tremolo device includes a rear mounted lever and connecting worm gear that alter string tension. Operation is by movement against the user's body. This device is integrated with the guitar and cannot be removed nor applied to guitars having conventional bridge designs.

In U.S. Pat. No. 5,400,684 to Duffy, a tremolo bar is secured to, and extends from, a guitar bridge to be operable from the back of the guitar. Tremolo effect is provided when a user moves the user's body against the tremolo bar. However, forces applied to the tremolo bar are directly transmitted to the bridge—and are not limited—such that the bridge attachment devices must restrain these forces, incurring risk of damage. The Duffy device requires a specialized bridge including a permanent stop and a pin secured to the face of the guitar. As discussed above, such permanent alterations of a guitar reduce value and usefulness and the forces transmitted to the bridge with the Duffy device easily alters the tuning of the instrument. As well the bridge design makes the Duffy device unusable with prior instruments.

What is desired is a "hands free" tremolo device that is simple and can be secured to conventional guitars having typical conventional pivoting bridge designs without significant alteration of the guitar and with no alteration of the bridge or other string tension control elements.

SUMMARY OF THE INVENTION

The present invention is a simple "hands-free" guitar tremolo and tremolo actuator that enables the tension in the playing strings of a solid body guitar to be altered during play to produce tremolo note effects. An actuator is attached to the guitar body through a rear cavity of the body of the playing instrument and rotates about an axis. A portion of the actuator bears against an external surface of a movable "floating" guitar bridge. Movement of the bridge by the actuator produces the desired effect. The actuator is controlled by the user during play by operation of an elongated lever that is connected to the actuator, or is integral to the actuator, and protrudes from the guitar body cavity. The lever is preferably curved and oriented to fit against a user's hip or waist when the guitar is held adjacent to the user in a typical mode of operation of an electric guitar. In play, tremolo effect is produced by the user by drawing the guitar toward the user's body such that the lever is forced toward the guitar body. In this manner, the user is allowed unhindered use of both hands for normal play of the guitar.

In a preferred embodiment, the inventive tremolo actuator is configured to be secured to existing solid body guitars having a pivoting bridge and front-operable tremolo arm. An actuator arm is pivotably secured within the guitar back cavity and bears against the bridge. An attached lever extends out of the cavity for access and operation by the user. The actuator is easily removed, without addressing fasteners, for convenient storage of the guitar after use. The extent of movement of the bridge by the actuator is self-limited by the geometry of the actuator to prevent damage to the instrument. This embodiment may be installed in a large portion of existing conventional guitars without material permanent modification of the guitar. Operation of a guitar's previously existing tremolo actuator is not prevented.

The present invention includes guitars incorporating the present inventive tremolo and tremolo actuator. The present invention provides a unique "hands-free" guitar tremolo actuator that provides an unique manner of play for solid body guitars. Additional aspects and advantages of the novel tremolo actuator design as described in the following drawings, detailed description, and claims will be apparent to one skilled in the art.

DESCRIPTION OF THE PREFERRED EMBODIMENTS

Figure 1:
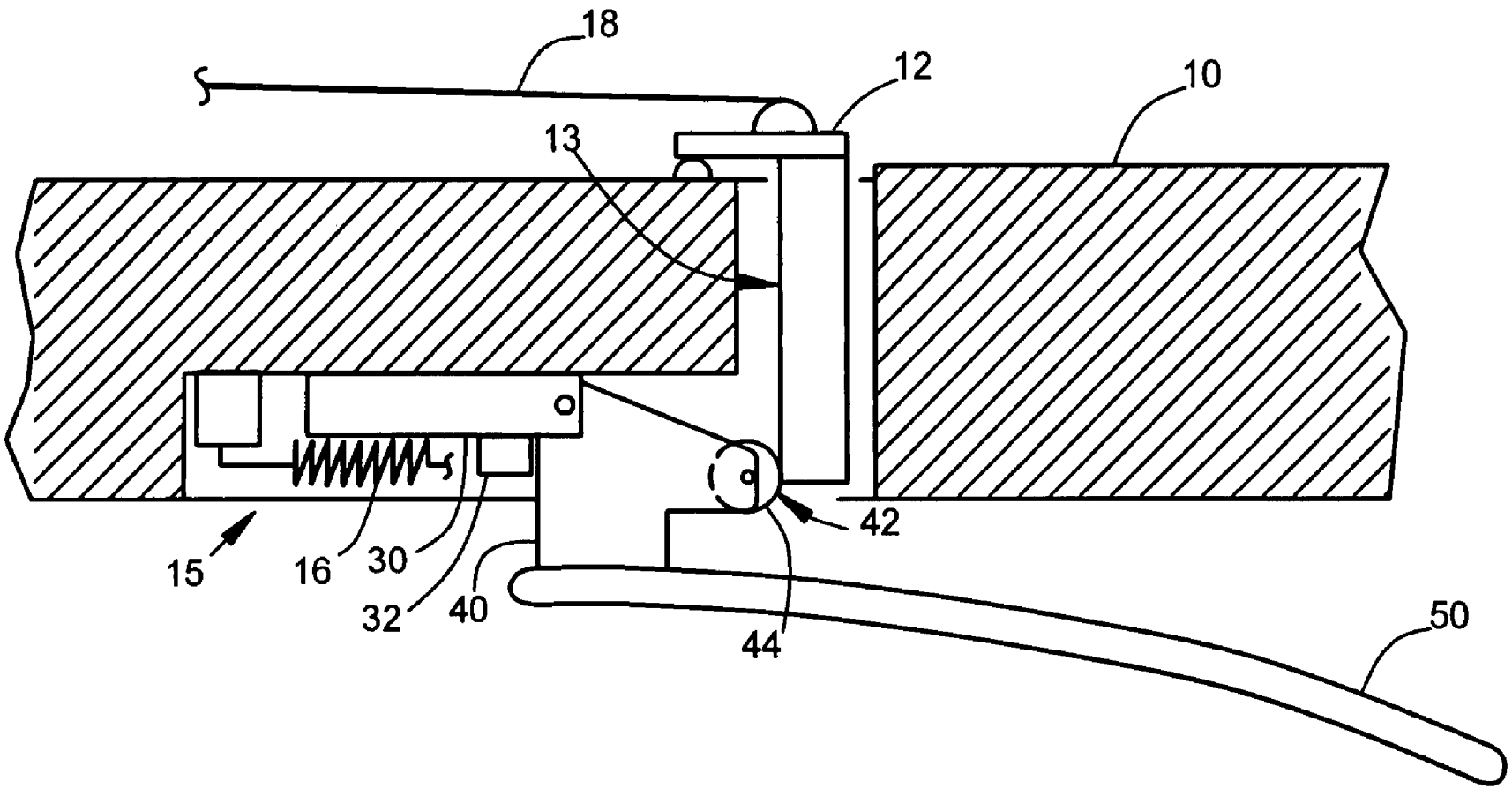
FIG. 1 is a side cross-section view of a solid bodied guitar including a tremolo device according to the invention.

FIG. 1 is a partial side cross-section view of a solid guitar body including a tremolo device according to the invention. The guitar body 10 is conventional and includes a conventional pivoting bridge 12 assembly as is typically found on what is commonly known as "Fender"™ style electric guitars, and may include a conventional hand-operated tremolo handle on the front face of the guitar (not shown). In fact, the inventive tremolo control device may be installed in many standard electric guitars (such as a contemporary Fender Stratocaster™ guitar) without modification of the operational elements of the guitar.

As shown in FIG. 1, the guitar body 10 has a back cavity 15 in which control elements of the bridge are contained. In conventional guitars, one or more springs 16 (most typically three) are located and anchored within the cavity 15 and are connected to the bottom of the bridge 12. The springs 16 are shown partially cut away for clarity. The function of the springs 16 is to retain the bridge 12 in place against the tension of the guitar playing strings 18. The springs 16 also allow for slight rotation of the bridge 12 to reduce the string tension and therefore alter their musical tone—enabling a tremolo effect.

In the present invention, a rigid receiver 30 is fastened securely to the guitar body 10 within the guitar cavity 15. The receiver 30 is configured to fit under and between the springs 16 such as to not interfere with the function of the springs 16. The receiver 30 provides a base and foundation for the moving elements of the inventive tremolo.

Pivotably attached to the receiver 30 is an actuator arm 40. The actuator arm 40 rotates about an axis centerline parallel to the axis of rotation of the bridge. The actuator arm 40 has a bearing surface 42 that contacts and, in operation, applies force to the side of the bridge 12. In the embodiment shown, the actuator arm 40 includes a roller 44 pinned to the actuator arm 40 that provides a rolling bearing surface to reduce friction and operating forces.

Located outside the cavity 15 is a "belly" bar 50, so named as it is generally designed to bear against the user's hip, midriff or "belly" during use. The belly bar 50 is a rigid extended handle secured to the actuator arm 40 to provide mechanical advantage and increased control to move the actuator arm 40 during use in guitar play. The length and shape of the belly bar 50 are selected for availability, ease of use and conforming to the user's body. The actuator arm 40 is shown extending out the cavity 15 to join the belly bar 50. Equally, the belly bar 50 may, alternatively, include an extending element to join with an actuator arm 40 entirely within the cavity 15. The belly bar 50 may be integral with the actuator arm 40 or a separable part.

In use, the guitar player moves the guitar body 10 toward the user's body such that the belly bar 50 is deflected toward guitar body 10. This causes the belly bar 50 and actuator arm 40 to rigidly rotate, thereby forcing the bearing surface 42 against the bridge flat exterior or outer surface 13. In response, the bridge 12 rotates in the same manner as in conventional tremolo action, with the same effect: change of string tension and tone. When a user moves the guitar body 10 away from the user, the tension in the guitar springs 16 returns the bridge 12 smoothly back to its static position, driving the actuator arm 40 and belly bar 50 to their original position. Counter rotation of the actuator arm 40 and belly bar 50 are limited by stop blocks 32 formed in the receiver 30 to which a portion of the actuator arm 40 returns and bears against when belly bar 50 is no longer depressed. Operation by pushing of the actuator arm 40 against an outer surface of the bridge 12 enables uninterfered movement of the bridge when the present actuator function is not desired. For example, a prior existing front surface-mounted actuator may be employed in its normal manner. The present design also leaves the bridge unaltered. Engagement by positive securing of the actuator to the bridge, via fastening elements or the like, is not suggested for these reasons.

Figure 2:
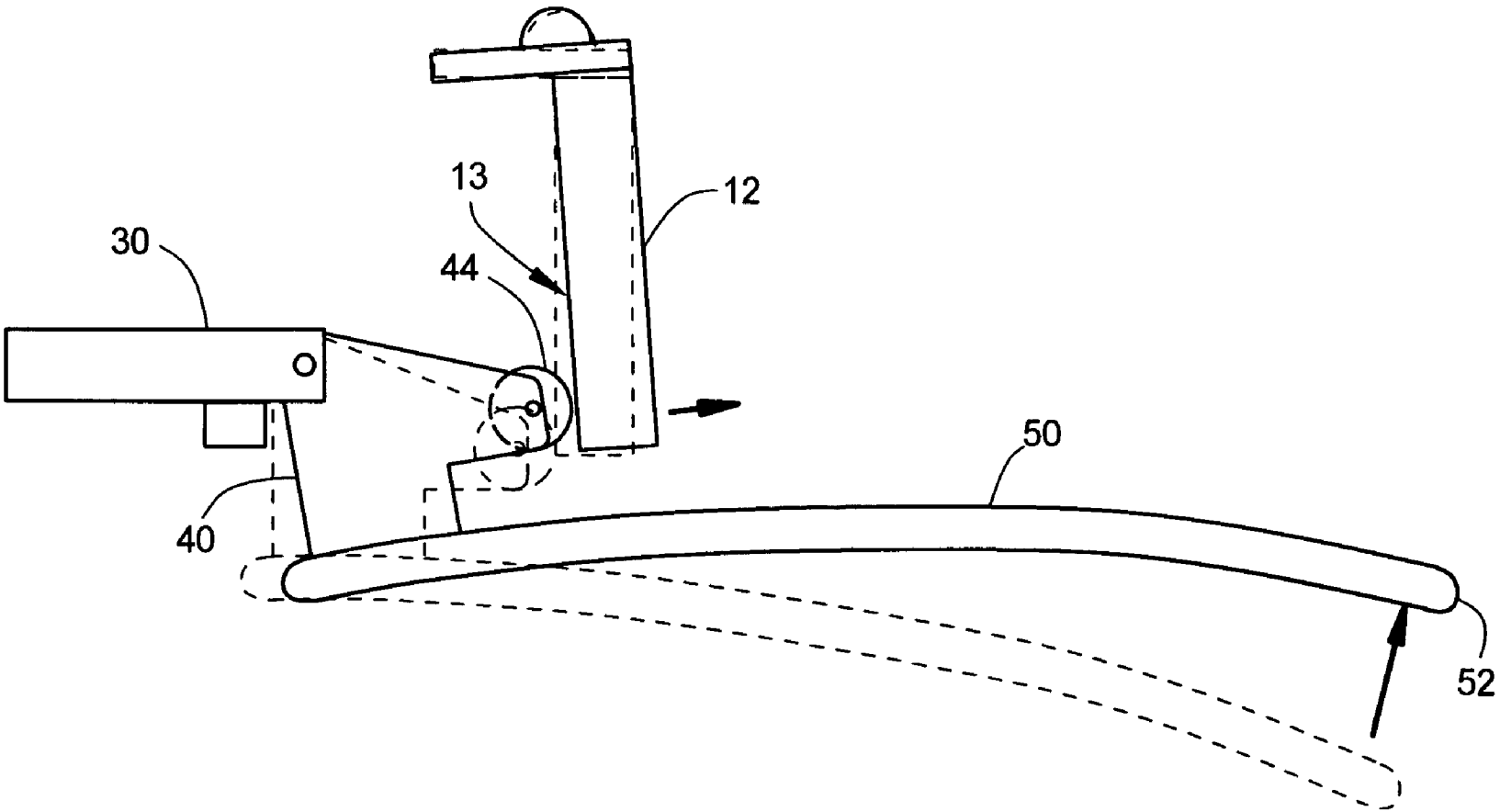
FIG. 2 is a schematic of the operational elements of the invention.

FIG. 2 is a schematic of the operational elements of the invention illustrating the movement of the bridge 12 when actuator arm 40 and belly bar 50 are operated in use. The structures are shown in dashed line in a static condition when no force is applied to the belly bar 50. The solid line figure is in the condition when the belly bar 50 is depressed as intended in use to reduce guitar string tension and tone. As can be seen, the receiver 30 is stationary. The greater displacement of the belly bar 50 at its distal end 52 as compared to that of the bridge illustrates the mechanical advantage of the belly bar 50. The displacement of the belly bar 50 also provides a comfortable and easily controlled range of motion for the user that is necessary to produce the variation of effects desired in playing of such musical instruments.

Figure 3A:
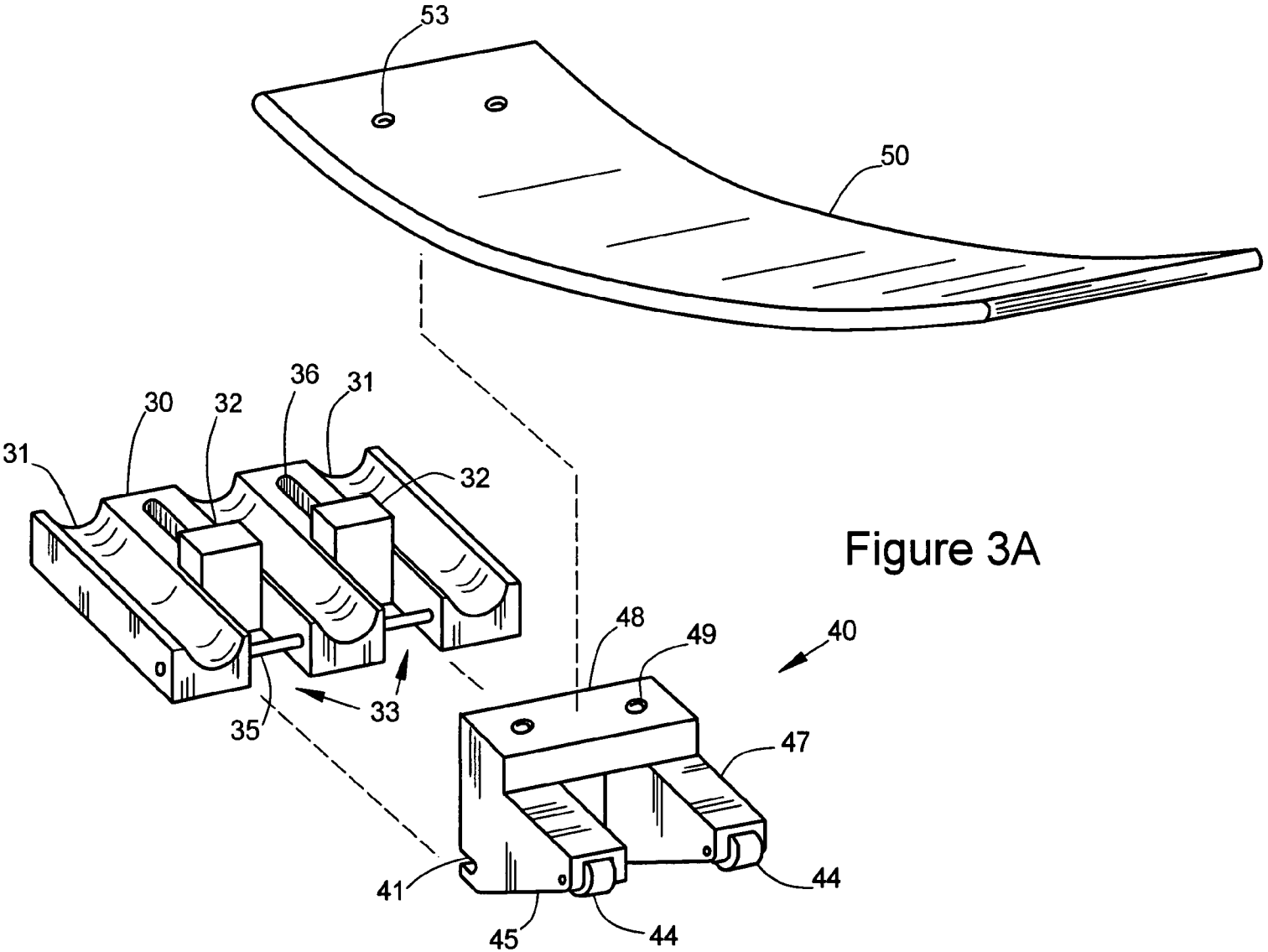
FIGS. 3*a* and 3*b* are perspective views of the elements of the inventive tremolo before installation in a guitar.
Figure 3B:
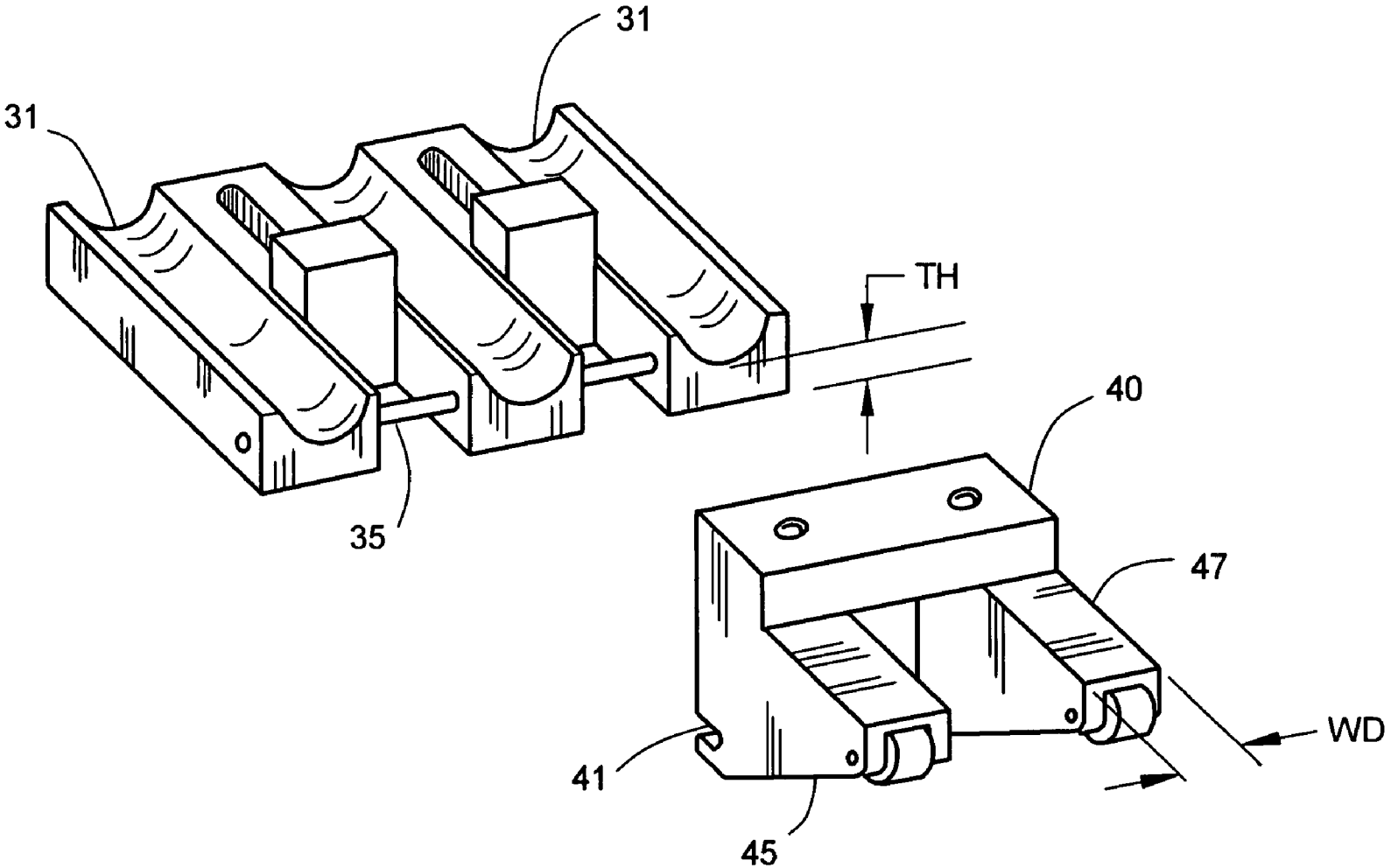

FIGS. 3*a* and 3*b* are perspective views of the elements of the inventive tremolo before installation in a guitar. FIG. 3*b* is enlarged to show more detail. The elements are arranged in the relative orientations as they are when assembled, but shown separated to allow viewing of the interconnecting parts. The receiver 30 is a generally square shaped body having a flat underside (not visible) to mate with the guitar body within the cavity. Three channels 31 are cut in the top side of the receiver 30. The channels 31 are spaced and shaped to allow the receiver 30 to reside under and extend around three guitar bridge springs 16 (FIG. 1) to maximize the receiver rigidity. When installed, the channels 31 allow the springs 16 to move axially and operate without interference. Alternatively, the receiver 30 may have a flat top surface. In both configurations, the receiver 30 has a clearance thickness TH in the regions oriented below the springs 16. The clearance thickness TH must be less than the spacing between the springs 16 and the guitar body 10. For most "Stratocaster"™ style guitars, a receiver having a clearance thickness of 0.08 inches is suggested. The receiver is preferably formed of aluminum, but may be cut or molded from other materials having sufficient strength and rigidity, including high density plastics, polyamides and other metals.

Between the channels 31, two through-slots 33 are cut in one end of the receiver 30 and parallel to the channels 31. The slots 33 bottom at raised vertical stop blocks 32 that extend above the channels 31 such that, upon assembly with a guitar, the stop blocks 32 are located between guitar springs 16. Two mounting slots 36 are provided to accept fasteners to pass and be secured in the guitar body for rigid mounting of the receiver 30. Other mounting methods may be used. The slots 36 provide some level of adjustment of the receiver position, relative to the guitar bridge, after placement of the fasteners.

At the opening of the slots 33 a steel through-pin 35 is mounted perpendicular to the slots 33. The receiver 30 may be cross-bored at an appropriate diameter to receive the pin 35 in a press fit at one end of the pin 35. The pin 35 provides an axial pivot bearing surface defining the centerline of the circular movement of the actuator arm 40.

The actuator arm 40 is divided into two equal and parallel portions 45, 47. Each arm portion 45, 47 is sized and configured to slide within a respective receiver slot 33 while rotating on the pin 35. Each arm portion 45, 47 includes a roller 44, each of which functions identically and coincidentally in the manner of the roller 44 discussed above. In this configuration, the reason for using a split actuator arm 40 having two portions is to provide stability and rigidity. While use of a single portion is feasible, the narrow space between guitar springs, limiting the width of a single actuator arm, makes such a single arm structure less preferred due to potential increased out-of-plane flexibility. To allow the arm portions 45, 47 to pass between adjacent springs 16 and connect with the receiver 30, the arm portions must have a clearance width WD less than the spacing between the springs 16. For most "Stratocaster"™ style guitars, arm portions having clearance equal to or less than 0.40 inches is suggested.

A cross plate 48 connects the two arm portions and serves as a mounting structure for the belly bar 50. The belly bar 50 is shown with two through-holes 53 configured to receive fasteners (not shown) which thread into threaded anchor holes 49 in the cross plate 48. Other conventional methods and structures for joining the actuator arm 40 and the belly bar 50 are contemplated, including forming an integral structure.

Each actuator arm portion 45, 47 is provided a transverse slot 41 which is configured to receive the receiver pin 35 to couple the actuator arm 40 to the receiver 30. A slot rather than a through-bore is preferred to enable simple de-coupling of the actuator arm 40, and then removal of the belly bar 50, when the receiver 30 is secured to a guitar.

Figure 4:
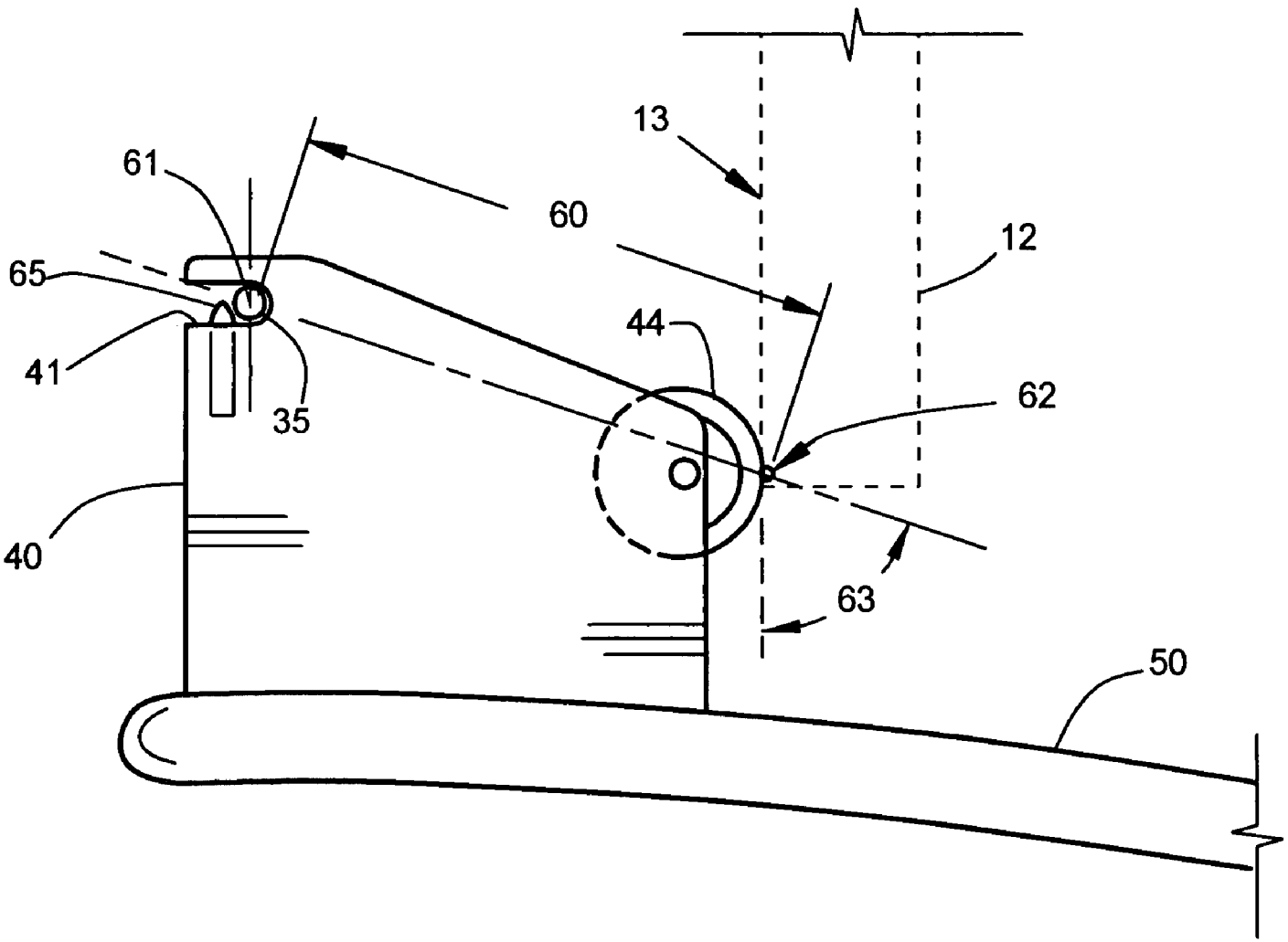
FIG. 4 is a detailed side view of an actuator arm according to the invention, illustrating the relative geometries of arm elements.

FIG. 4 is a detailed side view of one configuration of actuator arm according to the invention. The following discussion pertains generally to all configurations intended to carry out the benefits of the invention. Rotation of the guitar bridge 12 (shown dashed for distinction) is caused by displacement of the bottom of the bridge 12 by the inventive tremolo actuator arm 40. The magnitude of the displacement of the bridge 12 is a product of at least three factors: the length of the effective actuator arm 60, from the axis of rotation 61 to the (most distant) point of contact 62 with the bridge 12; the arm angle 63 of the effective actuator arm 60 relative to the bridge; and the operational angle of rotation of the actuator arm 40. For a guitar having a bridge geometry consistent with most conventional Fender Stratocaster™ guitars, the following Table 1 provides dimensions suggested for acceptable performance of the inventive tremolo.

TABLE 1

| Geometry Element | Dimension |
|---|---|
| Effective Arm length | 1.2 inch |
| Effective Arm Bridge Angle | 70 degrees |
| Full range actuator rotation angle | 19 degrees |

These dimensions provide a tone reduction of approximately three half steps in each string for typical electric guitar strings. This also provides a comfortable rotation angle of the belly bar, enabling good tone control in use.

The amount of tone change in tremolo desired, and hence the rotation needed, in a particular guitar bridge may differ from one guitar to another and from one musician user to another. Therefore, the particular dimensions of the actuator arm of the invention may differ with the situation and application. However, after the necessary rotation and displacement of the bridge at its bottom have been determined and the motion of the belly bar desired is selected, the geometry of the actuator arm may be easily determined from the above principles.

An additional benefit of the present inventive tremolo control device, is the ability to be self-limiting. In a static condition, when the actuator arm 40 is in contact with the bridge 12 but not exerting any force, the bridge 12 is balanced by the guitar string tension and opposing bridge spring forces. The arm angle 63 in this condition is less than 90 degrees. As the actuator arm 40 rotates and bears against the bridge such as to move it, the arm angle 63 increases until it reaches 90 degrees. The maximum deflection of the bridge 12 occurs when the arm angle is 90 degrees. If the actuator arm 40 is further rotated, the bridge movement is actually reduced. In this way, potentially damaging over-rotation of the bridge may be prevented. Note that in the table, the arm angle is the approximate complement angle to the full range actuator rotation angle (19 degrees). This is the desired geometry to provide self-limiting action.

The effective length of the belly bar 50, from axis of rotation to distal end, is preferably in the range of 6 to 7 inches. Lengths less than 4 inches provide less than desired sensitivity and control. Belly bar lengths greater than this range are likely to be cumbersome and unwieldy. The precise shape and curvature of the belly bar are not critical. However, the belly bar should extend generally parallel to the back of the guitar and be generally outwardly curving to conform to the user's body. A radius of curvature of 8 to 9 inches is suggested. The angle of the belly bar, with respect to the back of the guitar when installed, should provide sufficient clearance to enable the full range of the actuator rotation.

The actuator arm 40 of FIGS. 3 and 4 illustrate a valuable element provided in embodiments of the invention. As discussed above, a slot 41 rather than a through-bore is used in the actuator arm 40 to enable de-coupling of the actuator arm 40, and then removal of the belly bar 50, when the receiver 30 is secured to a guitar. As seen in the embodiment of FIG. 4, a retractable spring plunger 65 is mounted within the actuator arm 40 such as to provide a releasable capture for the receiver pin 35 when coupled. The back of the slot 41 is rounded to received the pin 35 such that the axis of rotation 61 of the actuator arm 40 is substantially coincident with the centerline of the pin 35.

Installation of the inventive tremolo is now discussed generally and with respect to the configuration of FIG. 3 and the guitar structure depicted in FIG. 1 as a reference. The receiver 30 is preferably mounted first in the guitar body. It is slid between, and positioned under, the guitar springs 16 and against the bottom of the guitar cavity. The approximate location of the receiver 30 may be established by temporarily coupling the actuator arm 40 and matching its roller (or other bearing surface) against the guitar bridge. The receiver 30 is then secured to the guitar body. To install the actuator arm 40, the slotted end is angled into the guitar cavity, between the bridge 12 and receiver 30, and snapped over the pin 35, the spring plunger 65 being forced out of the way as the pin 35 enters the slot 41. The stop 32 rotationally locates the actuator arm 40 adjacent the bridge 12 in position for use. After the receiver 30 is secured, a cavity cover having a reduced opening configured for the actuator arm 40 may be mounted on the back of the guitar body. To remove the belly bar 50 and actuator arm 40 for storage of the guitar, the belly bar may be lifted and rotated to de-couple it from the receiver 30 which may be stored with the guitar.

In the embodiments shown, the actuator surface bearing 42 on the bridge is the outer surface of a roller having rolling bearing elements. The actuator arm 40 and the roller 44 each rotate on axes parallel to the rotation axis of the bridge and the bridge outer surface 13 itself to eliminate sliding and reduce friction and operational forces. A roller bearing for this function provides the lowest friction and wear. Other bearing surface structures are contemplated. Alternative bearing surfaces may be provided by a sliding surface on the actuator arm. Such a sliding surface may be provided by a low friction region or material integral to, or attached to, the actuator arm.

Figure 5:
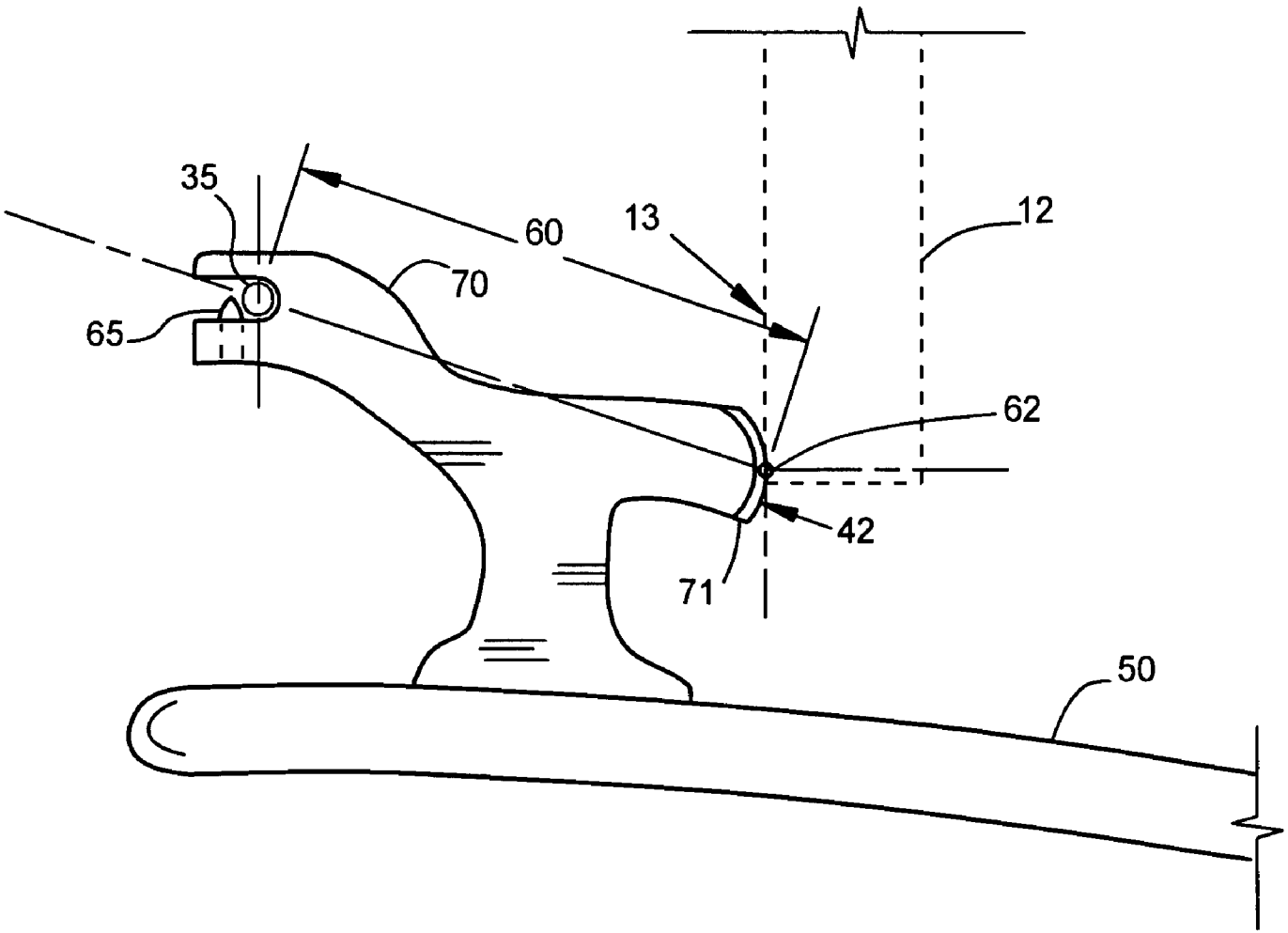
FIG. 5 is a side view of an actuator arm according to the invention having an alternative general shape.

FIG. 5 depicts such an alternative actuator arm 40 that also illustrates that the shape of the actuator may be greatly altered so long as the geometry of the operational elements meet the requirements of the invention. In FIG. 5, an aluminum actuator arm body 70 includes a high density, low friction, plastic surface pad 71 that is bonded to the actuator body 70 to replace the roller bearing of configuration of FIG. 4. The pad 71 has a bearing surface 42 that is curved and otherwise configured to slide with reduced friction against the bridge. Geometry of the operational elements of this alternative configuration is the same as that of FIG. 4. Replacement of the roller bearing as a bearing surface may be desired to reduce unit cost. However, wear due to friction makes this configuration less desirable.

In the above embodiments, the actuator arm moves in simple rotation on the receiver. In alternative embodiments, the actuator may include more complex mechanisms, such as a "four-bar" linkage or other mechanical devices capable of translating rotational motion of the belly bar into movement of an actuator against an external surface of the bridge in a similar manner.

Figure 6:
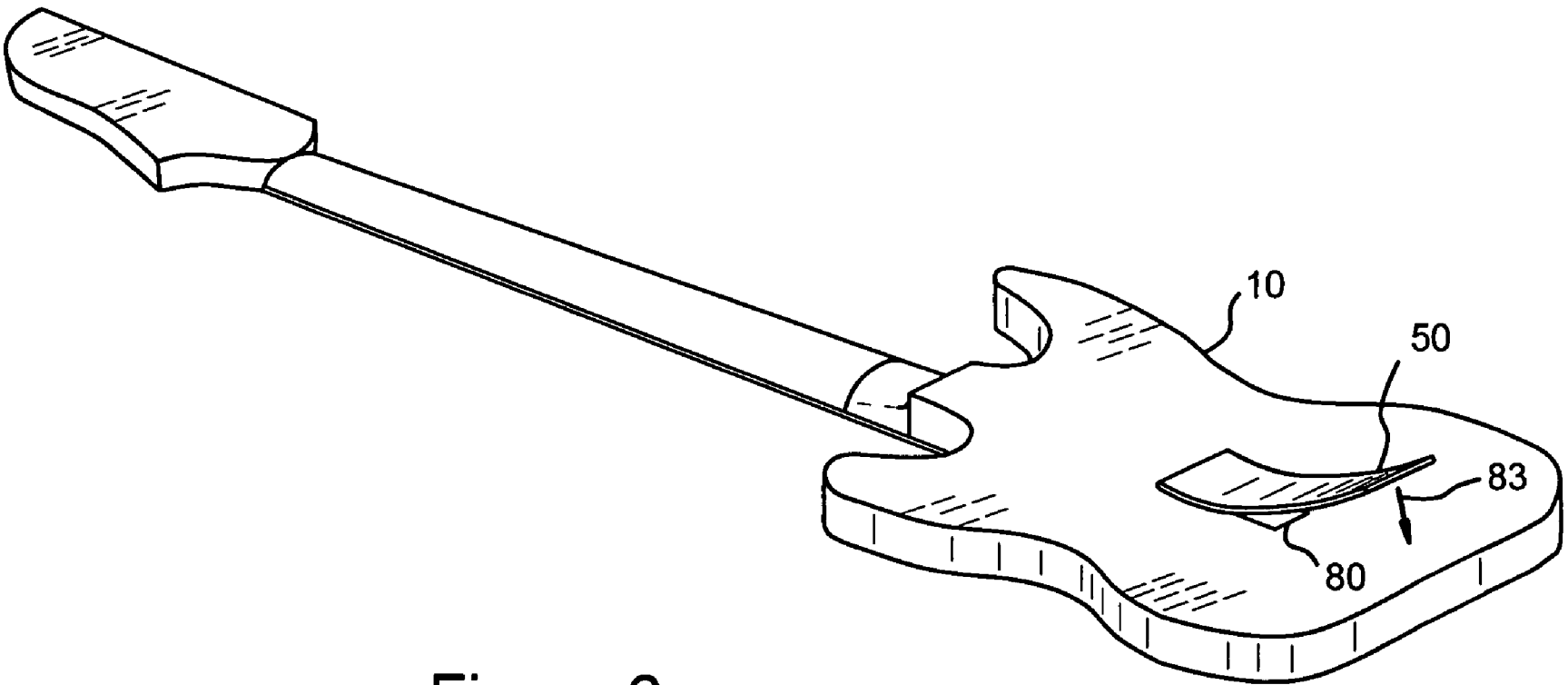
FIG. 6 is a rear view of a guitar according to the invention including the inventive tremolo actuator.

FIG. 6 is a rear view of a guitar according to the invention including a belly bar operated tremolo device as discussed above. The guitar has a solid body 10 and a cover plate 80 covering a rear cavity. The belly bar 50 and actuator arm (not visible in this view) may be inserted through an opening in the cover plate 80 to couple with an inventive receiver. The function of the cover plate 80 as the same as conventionally, for convenience of closing the cavity and hiding the functional elements within the cavity. Operation of the belly bar to create tremolo effect in the guitar is indicated by the motion 83 of the belly bar 50 toward the back of the body 10.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

We claim:

1. A tremolo actuator for a guitar having a rear body cavity and having a moveable bridge that extends into the body cavity, the actuator comprising:

an actuator arm;

a receiver configured to be mounted to the guitar within the body cavity;

means for pivotably securing the actuator arm to the receiver;

the actuator having a bearing surface configured to contact an outer surface of an extending portion of a guitar bridge extending into the cavity such as to travel over, while pushing against, the outer surface to rotate the bridge when the actuator arm is pivoted; and an operating lever extending from the actuator;

such that the operating lever may be operated outside the cavity and adjacent to the back of the guitar to rotate the bridge and change guitar string tension.

2. A tremolo actuator, according to claim 1, and wherein:

the means for securing comprises:

a bearing pin on the receiver, and the actuator arm configured to engage and bear on the pin.

3. A tremolo actuator, according to claim 2, and wherein:

the actuator arm is configured to be releaseably attached to the bearing pin.

4. A tremolo actuator, according to claim 3, and wherein:

the slot is configured to releaseably engage the bearing pin.

5. A tremolo actuator, according to claim 1, and wherein:

the actuator arm has an effective range of motion, with contact with the bridge, over which the bridge is moved no more than a predetermined maximum distance.

6. A tremolo actuator, according to claim 5, and wherein:

the actuator arm has an effective operating angle of 19 degrees.

7. A tremolo actuator, according to claim 1, and wherein:

the lever has a curved geometry.

8. A tremolo actuator, according to claim 7, and wherein:

the lever geometry has a radius of curvature of 8.5 inches.

9. A tremolo actuator, according to claim 8, and wherein:

the lever geometry has an effective length in the range of 6 to 7 inches.

10. A tremolo actuator, according to claim 1, and wherein:

the actuator arm includes a roller surface comprising the bearing surface.

11. A tremolo actuator, according to claim 10, and wherein:

the actuator arm has an effective arm length of 1.2 inches from a pivot axis to the bearing surface.

12. A stringed musical instrument, comprising an instrument body having a rear body cavity;

a moveable bridge extending into the cavity;

a tremolo actuator according to claim 1.

13. A stringed musical instrument, comprising:

an instrument body having a rear body cavity;

a pivotally moveable bridge that changes the tension on the instrument strings when pivoted extending into one end of the cavity and having an outer interfacing surface on its extending portion;

at least one string tension balancing spring disposed within the cavity and functionally secured to the extended portion of the bridge at the bridge end of the cavity and secured to the instrument body at the other end of the cavity;

a receiver secured to the instrument body between the two ends of the cavity and between the instrument body and the at least one balancing spring;

a rigid actuator arm pivotably secured to the receiver at a pivot axis, the actuator arm also having a bearing surface located an effective arm length distant from the pivot axis that allows an effective range of motion, the bearing surface moveably contacting the interfacing surface throughout the range of motion;

a lever extending from the actuator arm and out of the cavity, such that movement of the lever outside the cavity causes the actuator to pivot on its axis.

14. A stringed musical instrument, according to claim 13, and further comprising:

a roller secured to the actuator arm, the roller including the bearing surface.

15. A stringed musical instrument, according to claim 13, and wherein:

the bearing surface comprises a curved plastic pad secured to the actuator arm.

16. A stringed musical instrument, according to claim 13, and wherein:

the effective arm length is 1.2 inches.

17. A stringed musical instrument, according to claim 13, and wherein:

the effective range of motion is an angle of 19 degrees.

18. A tremolo actuator for a guitar having a rear body cavity and having a moveable bridge that extends into the body cavity, the actuator comprising:

an actuator arm configured to be pivotably secured to the guitar within a guitar rear body cavity;

the actuator having a bearing surface configured to contact an outer surface of a guitar bridge extending into the cavity such as to travel over, while pushing against, the outer surface to rotate the bridge when the actuator arm is pivoted; and an operating lever extending from the actuator;

such that the operating lever may be operated outside the cavity and adjacent the back of the guitar to rotate the bridge and change guitar string tension.

19. A tremolo actuator, according to claim 18, and wherein:

the operating lever is integral with the actuator.

20. A tremolo actuator, according to claim 18, and wherein:

the actuator has a roller including the bearing surface.

* * * * *